US010502056B2

(12) United States Patent
Sollami

(10) Patent No.: US 10,502,056 B2
(45) **Date of Patent: *Dec. 10, 2019**

(54) REVERSE TAPER SHANKS AND COMPLEMENTARY BASE BLOCK BORES FOR BIT ASSEMBLIES

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/257,186

(22) Filed: Sep. 6, 2016

(65) Prior Publication Data

US 2017/0089198 A1 Mar. 30, 2017

Related U.S. Application Data

(60) Provisional application No. 62/234,749, filed on Sep. 30, 2015.

(51) Int. Cl.

| | |
|---|---|
| ***E21C 35/19*** | (2006.01) |
| ***E21C 35/183*** | (2006.01) |
| *E21C 35/18* | (2006.01) |

(52) U.S. Cl.

CPC ..... *E21C 35/19* (2013.01); *E21C 35/183* (2013.01); *E21C 2035/1803* (2013.01); *E21C 2035/1806* (2013.01); *E21C 2035/191* (2013.01)

(58) Field of Classification Search

CPC ... E21C 35/19; E21C 2035/191; E21C 35/197

See application file for complete search history.

(56) References Cited

U.S. PATENT DOCUMENTS

| | | | |
|---|---|---|---|
| 2,382,947 | A | 7/1944 | Brozek |
| 3,342,532 | A | 9/1967 | Krekeler |
| 3,397,012 | A | 8/1968 | Krekeler |
| 3,476,438 | A | 11/1969 | Bower, Jr. |
| 3,519,309 | A | 7/1970 | Engle |
| 3,833,264 | A | 9/1974 | Elders |
| 3,833,265 | A | 9/1974 | Elders |
| 3,865,437 | A | 2/1975 | Crosby |
| 4,084,856 | A | 4/1978 | Emmerich |
| 4,247,150 | A | 1/1981 | Wrulich et al. |
| RE30,807 | E | 12/1981 | Elders |
| 4,310,939 | A | 1/1982 | Iijima |
| 4,453,775 | A | 6/1984 | Clemmow |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — David J Bagnell
*Assistant Examiner* — Michael A Goodwin
(74) *Attorney, Agent, or Firm* — Mercedes V. O'Connor; Rockman Videbeck & O'Connor

(57) ABSTRACT

A bit holder and corresponding base block are disclosed wherein a slotted shank of the bit holder includes a reverse taper portion adjacent a distal end thereof. A base block with a bore for receiving said shank includes a corresponding hollow portion of reverse taper configuration that will tend to retain said shank therein.

21 Claims, 2 Drawing Sheets

(56) References Cited

U.S. PATENT DOCUMENTS 4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A 10/1987 Sollami
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 1/2001 Topka, Jr.
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 * 8/2011 Monyak ..... E21C 35/197 299/107
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 * 6/2012 Hall ..... E21C 35/183 299/102
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.
9,028,008 B1 5/2015 Bookhamer
9,039,099 B2 5/2015 Sollami
9,316,061 B2 4/2016 Hall

(56) References Cited

U.S. PATENT DOCUMENTS

| | | | | |
|---|---|---|---|---|
| 9,879,531 | B2 | 1/2018 | Sollami | |
| 2002/0074850 | A1* | 6/2002 | Montgomery, Jr. | E21C 35/197 299/102 |
| 2002/0074851 | A1 | 6/2002 | Montgomery, Jr. | |
| 2002/0109395 | A1 | 8/2002 | Sollami | |
| 2002/0167216 | A1 | 11/2002 | Sollami | |
| 2002/0192025 | A1 | 12/2002 | Johnson | |
| 2003/0015907 | A1 | 1/2003 | Sollami | |
| 2003/0047985 | A1 | 3/2003 | Shifter | |
| 2003/0052530 | A1 | 3/2003 | Sollami | |
| 2003/0122414 | A1 | 7/2003 | Sollami | |
| 2003/0209366 | A1 | 11/2003 | McAlvain | |
| 2004/0004389 | A1 | 1/2004 | Latham | |
| 2004/0174065 | A1* | 9/2004 | Sollami | B28D 1/188 299/106 |
| 2005/0212345 | A1 | 9/2005 | Sleep et al. | |
| 2006/0071538 | A1 | 4/2006 | Sollami | |
| 2006/0186724 | A1 | 8/2006 | Stehney | |
| 2006/0261663 | A1 | 11/2006 | Sollami | |
| 2007/0013224 | A1* | 1/2007 | Stehney | E21C 35/197 299/104 |
| 2007/0040442 | A1 | 2/2007 | Weaver | |
| 2007/0052279 | A1* | 3/2007 | Sollami | B28D 1/188 299/106 |
| 2008/0035386 | A1 | 2/2008 | Hall et al. | |
| 2008/0036276 | A1 | 2/2008 | Hall et al. | |
| 2008/0100124 | A1 | 5/2008 | Hall et al. | |
| 2008/0145686 | A1 | 6/2008 | Mirchandani | |
| 2008/0164747 | A1 | 7/2008 | Weaver et al. | |
| 2009/0146491 | A1 | 6/2009 | Fader et al. | |
| 2009/0160238 | A1 | 6/2009 | Hall et al. | |
| 2009/0256413 | A1 | 10/2009 | Majagi | |
| 2009/0261646 | A1 | 10/2009 | Ritchie et al. | |
| 2010/0045094 | A1 | 2/2010 | Sollami | |
| 2010/0244545 | A1 | 9/2010 | Hall | |
| 2010/0253130 | A1 | 10/2010 | Sollami | |
| 2010/0320003 | A1 | 12/2010 | Sollami | |
| 2010/0320829 | A1 | 12/2010 | Sollami | |
| 2011/0006588 | A1 | 1/2011 | Monyak et al. | |
| 2011/0089747 | A1 | 4/2011 | Helsel | |
| 2011/0175430 | A1 | 7/2011 | Heiderich et al. | |
| 2011/0204703 | A1 | 8/2011 | Sollami | |
| 2011/0254350 | A1 | 10/2011 | Hall | |
| 2012/0001475 | A1 | 1/2012 | Dubay et al. | |
| 2012/0027514 | A1 | 2/2012 | Hall | |
| 2012/0056465 | A1 | 3/2012 | Gerer et al. | |
| 2012/0068527 | A1 | 3/2012 | Erdmann | |
| 2012/0104830 | A1 | 5/2012 | Monyak et al. | |
| 2012/0181845 | A1 | 7/2012 | Sollami | |
| 2012/0242136 | A1 | 9/2012 | Ojanen | |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1 | 12/2012 | Swope | |
| 2013/0169023 | A1 | 7/2013 | Monyak | |
| 2013/0181501 | A1 | 7/2013 | Hall et al. | |
| 2013/0199693 | A1 | 8/2013 | Tank et al. | |
| 2013/0307316 | A1 | 11/2013 | Roetsch et al. | |
| 2014/0035346 | A1 | 2/2014 | Fundakowski et al. | |
| 2014/0110991 | A1* | 4/2014 | Sollami | E21C 35/183 299/79.1 |
| 2014/0232172 | A1 | 8/2014 | Roth et al. | |
| 2014/0262541 | A1 | 9/2014 | Parsana et al. | |
| 2014/0326516 | A1 | 11/2014 | Haugvaldstad | |
| 2015/0028656 | A1 | 1/2015 | Sollami | |
| 2015/0035343 | A1 | 2/2015 | Ojanen | |
| 2015/0198040 | A1 | 7/2015 | Voitic et al. | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0102550 | A1 | 4/2016 | Paros et al. | |
| 2016/0194956 | A1 | 7/2016 | Sollami | |
| 2016/0229084 | A1 | 8/2016 | Lehnert | |
| 2016/0237818 | A1 | 8/2016 | Weber et al. | |
| 2017/0089198 | A1 | 3/2017 | Sollami | |
| 2017/0101867 | A1 | 4/2017 | Hall et al. | |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| GB | 1114156 | 5/1968 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

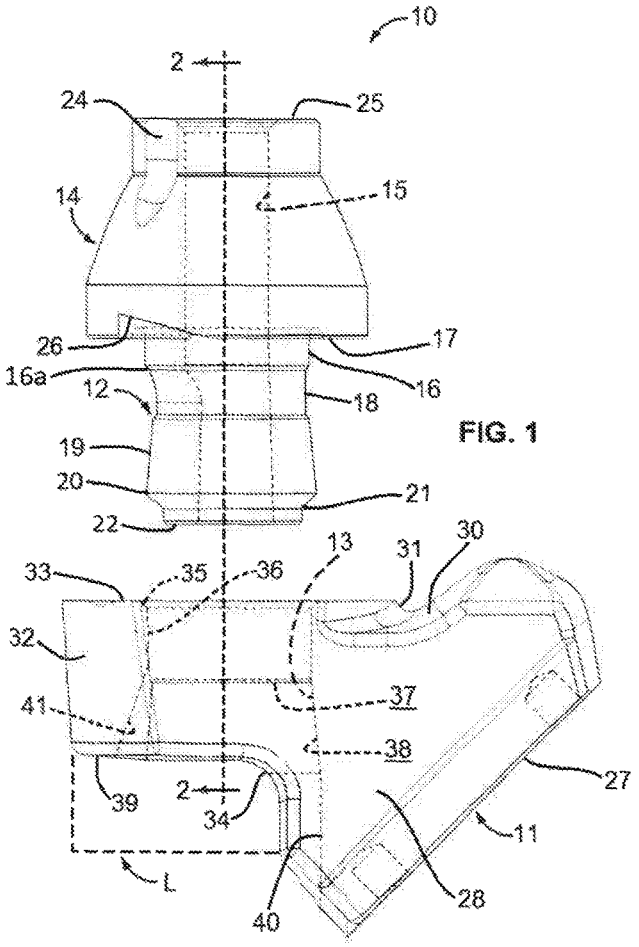
FIG. 1
FIG. 2
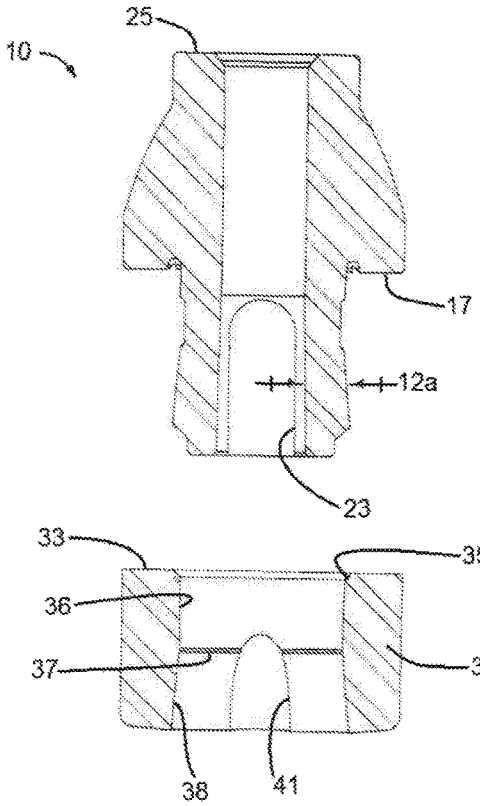

REVERSE TAPER SHANKS AND COMPLEMENTARY BASE BLOCK BORES FOR BIT ASSEMBLIES

This application claims priority to U.S. provisional application Ser. No. 62/234,749, filed Sep. 30, 2015, to the extent allowed by law and the contents of which are incorporated herein by reference in their entireties.

This invention relates in general to bit assemblies for road milling, mining and trenching equipment and more particularly to a complementary reverse taper configuration for retaining together certain parts in the assemblies.

BACKGROUND OF THE INVENTION

In the world of heavy duty equipment, mining, trenching and road milling equipment needs to be built to take the strain and wear of removing asphalt, concrete, rock, minerals, coal and the like from the earth's surface and subterrain.

Generally, some very hard material, such as tungsten carbide and lately industrial and man-made diamond material provide the leading edge of such heavy duty equipment. In road milling, the surface removing equipment includes a rotatable drum on which a plurality of bit assemblies, including the aforementioned very hard material tips, are positioned in close proximity, usually in spiral or chevron shape, on the outside of a rotatable drum.

Prior to applicant's ground-breaking inventions found in U.S. Pat. Nos. 6,371,567 and 6,585,326, the very hard tips, found in what is termed "bits" were rotatably mounted on bit holders, or intermediate parts, that were fastened to base blocks which, in turn, were mounted on the outside of such drums, or on the outside of plates positioned on the outside of heavy duty connected links. The intermediate parts or bit holders were retained on the base blocks by bolting or by use of other retainer distal end means. Applicant's prior inventions eliminated the need for the nuts at the back end of the base blocks by providing a bit holder having a hollow slotted shank with an increased overall super interference fit being driven and holding same securely against the base block bore.

Especially with road milling machines and other heavy duty equipment having established configurations, the need for new and improved material removing assemblies at the point of their contact with the material to be removed, has necessitated that the equipment, even if improved, be largely interchangeably compatible.

With traditional bit holders having generally cylindrical shanks nominally 1½ inches in diameter and about 2½ inches in length to fit into previously existing base block bores, applicant's improved interference fit bit holders had similar diameter and length shanks.

Given the heavy duty nature of highway milling and material removal, the ability to drive in both bit holders having removable bits mounted therein, and also unitary combination bit/bit holders that include either industrial diamonds or PCD material at the tips thereof into base blocks and retain them therein is highly desirable. In this regard, improved access to the rear of base blocks for punching out bits and combination unitary bit/holders from their mounted position in the base blocks would be very desirable.

A need has arisen for base blocks having shorter length bit holder bores and, consequently, improved bit holders and combination unitary bit/holders having shortened shanks thereon which matingly engage and are retained in such base block bores.

SUMMARY OF THE INVENTION

The invention resides in a bit holder having an upper body portion and a hollow slotted generally cylindrical shank depending from the upper body portion. An outer surface of at least a first portion of the length of the shank adjacent its distal end having a taper extending away from an axis of the shank as it descends toward the distal end thereof.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

FIG. 1 is a side elevational view of a bit holder and its corresponding base block, with tapers exaggerated for visibility, constructed in accordance with the present invention;

FIG. 2 is a cross-sectional view taken substantially along line 2-2 of FIG. 1 also showing an outline of the bit holder and the base block bore, constructed in accordance with the present invention;

DETAILED DESCRIPTION OF THE PREFERRED EMBODIMENT

Figure 3:
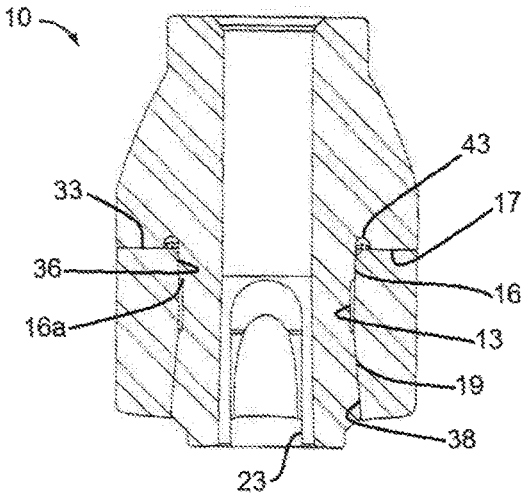
FIG. 3 is a cross sectional view similar to FIG. 2 showing the bit holder mounted in the base block bore.

Referring to FIGS. 1 and 2, a bit holder 10 and its corresponding base block 11, constructed in accordance with the present invention, shown in exploded form in FIG. 1, includes a shortened bit holder shank 12 and a complementary shortened base block bore 13. The bit holder has a generally frustoconical body 14 with a hollow central bore 15 therethrough, and continuing through a generally hollow cylindrical slotted shank 12. In this preferred embodiment the shank 12 has a reduced effective length approximating 1½ inches (total length 1¾ inches) with a nominal diameter of 1½ inches, the diameter varying along its length. A preferred embodiment of the shank 12 includes a¼ inch long top portion 16 that integrally connects with the bottom 17 of the generally frustoconical (could be other shapes) body 14, a shoulder **16*a* (FIGS. 1-3), a central reduced diameter portion 18 approximately ½ inch in axial length and a reverse taper portion 19 approximately ¾ inch in length that expands as it descends from the reduced diameter portion 18 to its terminus 22 adjacent a short (¼ inch) distal end portion 21. The shoulder 16*a* is disposed between the generally cylindrical or tapered top portion 16 and the reduced diameter portion 18. A diameter of the shoulder 16*a* decreases, or steps down, as it axially extends from the upper portion 16 to the middle portion 18**.

The shank 12 of the present invention also includes an elongate slot 23 extending from the distal end 22 of the shank 12 through the reverse taper portion 19, through the reduced diameter portion 18 and terminating adjacent the top increased diameter portion 16. The slot 23 has about the same percentage length to shank length ratio with the shortened shank of about 1½ inches to the 1¾ inch to shank total shank length as slots utilized with the longer 2½ inch shanks. In this preferred embodiment, the slot 23 extends upwardly to the increased diameter top portion 16 of the shank 12 to allow radial deformation or compressibility of the top portion 16 of the shank 12.

While in the preferred embodiment, the upper body portion 14 includes cutouts 24 (one shown) (FIG. 1), shown adjacent the top 25 thereof for driving a bit (not shown) out of the top 25 of the bit holder 10 and out of the top of the bit holder bore 15, and wedge shape undercuts 26 (one shown) adjacent the rear annular flange 17 of the body 14 to provide for fork shaped tools to be inserted therein to help drive the bit holder 10 from the base block 11. The distal end 22 of the shank 12 includes a mostly solid annular wall, with the exception of the slot 23 and of the hole 15 bit holder bore, that provides a substantially flat surface for receiving a drift pin of suitable diameter, or other extractor, which may be utilized to drive the bit holder shank 12, or a bit shank, from the base block bore 13.

The base block 11 shown in FIG. 1 includes a generally flat or somewhat hollow radius segment shape at its mounting end 27 that is adapted to be affixed (as shown) to either the cylindrical surface of a drum, or a plate mounted on top of the outside surface of the drum or of the heavy duty connected links (not shown). The mounting portion 28 of the base block 11 further includes a chevron shape top portion 30 that recedes on each side from a central spine 31 providing a pathway for loosened road surface material to move efficiently around the base block 11.

Outwardly of the mounting portion 28 is a generally annular bit holder receiving portion 32 having a substantially flat annular top surface 33 and a shortened axial body depth about 1½ inches in height. In this preferred embodiment, the bit holder block receiving portion 32 comprises an enclosed bore portion that includes a multi segment bit holder block bore 13, shown in dotted line. The shortened body height has there subjacent an L shape bottom surface 34 which may be considered a cutout from prior base blocks having the 2⅜ inch length bit holder block bore.

The preferred embodiment of the bit holder block bore 13, as shown in FIGS. 1 and 2, includes a generally annular countersink 35 adjacent the top thereof, a 1 degree per side tapered upper segment 36 immediately subjacent the top countersink that provides at its bottom a generally annular waistline 37 forming the narrowest portion of the bore 13 and a reverse taper or generally expanding taper 38 extending subjacent the waistline to the L shape cutout portion 34.

The countersink 35 and tapered upper side are preferably machined surfaces. The expanding taper bore surface is preferably machined from the waist 37 through the horizontal side 39 of the L shape bottom portion to the edge 34 of the machined portion.

An arcuate or radial cutout segment below line 34, with its innermost border shown at 40, extends toward the bottom of the base block mounting portion 28 and does not have to be machined.

While the slot 23 in the bit holder shank 12 may be of a number of widths, depending upon the exact configuration of the side wall thickness (about ⅜ inch), the reverse taper angle of the reverse taper portion 19 of the shank 12, and the hardness and compressive strength of the specific steel utilized for the bit holder 10, the slot shown 23 is about ⅝ inches in width.

While the top taper portion 36 of the bit holder block bore shown in the preferred embodiment includes a 1 degree taper section, it could also, within the outlines of the present invention, be a straight hollow cylindrical configuration or a continuous reverse taper portion through the base block 11. The reverse taper portion 38 in this preferred embodiment may vary from about 0.001 to 15 degrees per side reverse taper.

The respective constant reverse taper portions of the shank 19 and the base block bore 36 do not have to be identical reverse tapers. Applicant is presently working within limits of about 0.001 of a degree to about 2 degrees per side. Also, applicant's prior co-pending application (Ser. No. 14/959,551, the contents of which are incorporated herein by reference) have discussed differential reverse tapers that also will provide sufficient radial holding forces.

In operation, within the present invention, the compressibility of the side wall 12*a* of the bit holder shank 12 constructed in accordance with the present invention allows the shank to be driven into the base block bore 13 by compressing the outer circumferential perimeter of the shank 12 into the bore 38 of the frustoconical reverse taper segment 19 of the shank. When the reverse taper portion 19 of the shank 12 reaches the reverse taper portion 38 of the base block bore 13, the shank 12 will more easily be driven into the base block bore 38 as it expands until the reverse taper portion 19 is generally fully positioned in the base block 12. The shank 12 is then nearly complementary to the hollow frustoconical reverse taper portion 38 of the base block bore 13 with the rear annular flange 17 of the bit holder body 14 seating on the top annular portion 33 of the base block bit holder mounting portion 32.

Please note that within the present invention, the reverse taper portion in this embodiment, variable degrees of reverse taper per side, will be similar in reverse taper 19 to the angle of the reverse taper portion 38 of the bottom of the base block bore 13. It doesn't have to be identical and variations may be utilized. The aim in the present invention is to provide a reverse taper portion 19 of the bit holder that by its configuration tends to be seated in the base block bore 38 and has an aversion to coming out of the base block bore 13 unless it is driven out by an extractor.

This is an important feature of applicant's invention that does not exist in prior embodiments of a super interference sized slotted shank that may be driven into a base block bore. A super interference is defined as an interference greater than that found in the most extreme fit tables of engineering design handbooks for solid shaft diameters. The slot and hollow shank allows for elastic radial compression of the shank through the waist of the base block bore providing increased compressive holding force between the shank and the corresponding portion of the base block bore when fully inserted therein.

Referring to FIG. 3, the bit holder 10 is shown as it appears when driven completely into the base block bore 13 such that the rear annular flange 17 of the bit holder body 14 seats on the top annular wall 33 of the bit holder receiving portion 32 of the base block 11 and the shank 12 is fully driven into the base block bore 13. At the bottom of the top quarter inch expanded diameter segment 16 of the shank 12, the bottom edge 16*a* of that portion provides an almost annular interference fit with the one degree tapering upper segment 36 of the base block bore 13. The existence of the slot 23 extending to this upper quarter inch segment 16 allows the generally annular force or shrink type interference fit of 0.001-0.003 inch for a 1½ inch diameter shank to be increased and have a substantial ring contact rather than a matching interference contact that provides a contact area which may be about ⅛ inch in height. This generally force or shrink type interference fit combined with the annular inset groove 43 in the bit holder body 14 between the shank 12 and the rear annular flange 17 of the upper body portion lessens stress between the shank 12 and the bit holder body 14 when it is driven into the base block bore 13.

The reduced diameter section 18 of about ½ inch in axial length is about 0.020 inch per side less in diameter than the top 16 and reverse taper sections 19 of the shank 12. As shown most clearly in FIG. 3, when the shank 12 is completely driven into the base block bore 13, the reverse taper portion 19 of the shank 12 and the reverse taper of the base block bore 38 generally match in complementary fashion. This provides a structure that reduces the ability of the shank to self withdraw from the base block bore during the extreme in-use forces put upon the bit holder 10 or its corresponding bit (not shown). And yet, the wedge shaped undercuts 26 and the angularly slotted rear 40 of the base block bore 13 together with the shortened length of the base block bore 36-38, provide added space for the acceptance of various shaped extraction tools which may be utilized to drive the bit holder 10 from the base block bore 13 when desired.

Figure 4:
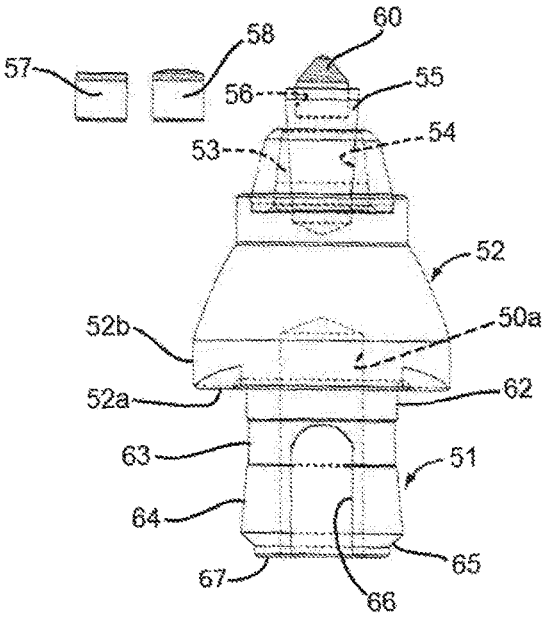
FIG. 4 is a front elevational view of a combination unitary bit/bit holder, with tapers exaggerated for visibility, constructed in accordance with the present invention, with a PCD tipped insert.

Referring to FIG. 4, a unitary bit/bit holder 50 is shown, constructed in accordance with the present invention, and includes a shank 51 and a body portion 52 having a generally axially extending annular cup portion 53 with a recess 54 therein. That recess matingly accepts a transition member 55 which may be cylindrical, or slightly tapered as shown in FIG. 4. This transition member 55 may be made of steel, tungsten carbide or the like as desired and includes at the top thereof, a generally cylindrical recess 56 into which a hardened tip, such as a diamond or PCD layer or coated tip, or a thermally stable polycrystalline member, is affixed, generally by brazing.

As noted in FIG. 4, the diamond coated top thereof may be flat 57, oval 58, cone shaped 60 or the like. In this embodiment, the transitional member is 55 preferably made of tungsten carbide. Outwardly of the annular uppermost extending cup portion 53 of the body, is an annular tungsten carbide ring or shroud 61 that provides added support and wear resistance to withstand material flowing around the outside of the bit/bit holder 50. The diamond tip members 57, 58, 60 shown in FIG. 4 are 0.500 inch diameter to about 0.565 inch diameter at their base and are commercially obtainable from a number of sources. The shank 51 of the embodiment shown in FIG. 4 is similar to the shank shown in FIGS. 1, 2 and 3 having a ¼ inch upper body enlarged diameter portion 62, a reduced diameter central portion 63 and a reverse taper portion 64 approximately ¾ inch in axial length ending in a distal end portion 65 about ⅛ to ¼ inch in axial length.

The slot 66 in the shank 51 is similar to the slot 23 shown in FIG. 3, approximately ⅝ inch in width and extending upwardly from the distal end 67 to the top increased diameter portion 62. While the slot 66 shown here has parallel sides, it will be understood that the slot may have differing configurations, with a wider slot leading to a more compressible shank 51.

Figure 5:
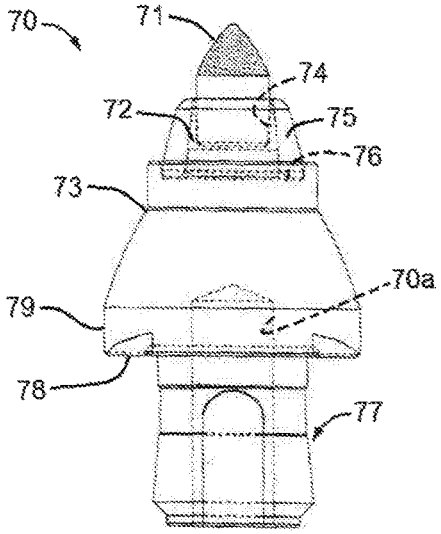
FIG. 5 is a front elevational view of a combined unitary bit/bit holder having an increased diameter PCD insert integrally mounted on the top of the bit holder body.

Referring to FIG. 5, a bit/bit holder 70, constructed in accordance with the present invention, is substantially identical to that shown at 50 in FIG. 4, with the exception that an enlarged hardened tip or hardened tip insert 71 having a diameter approximating ¾ inch at its base is fitted into the generally annular axially extending flange 72 at the top of the body portion 73 of the bit/bit holder. This insert 71 is fitted into a substantially cylindrical recess at the top of the body portion 73. That recess may also have a slight taper therein, depending on the configuration of the base of the TSP diamond or PCD diamond layered or coated insert 71.

Like the embodiment shown in FIG. 4, the embodiment of FIG. 5 also includes an annular tungsten carbide ring 75 positioned outwardly thereof and affixed thereto, preferably by brazing, into an annular recess 76 outwardly adjacent the bottom of the annular axially extending flange.

As shown in FIGS. 4 and 5, the hollow portion 50*a*, 70*a* of the shank 77 extends preferably upwardly to the rear annular flange 52*a*, 78 of the body, respectively, and in these embodiments, extends upwardly past the top of the tire portion 52*a*, 79, respectively, of the body where it terminates leaving the remainder of the upper narrowing portion of the body a solid structure.

The embodiment shown in FIGS. 1, 2 and 3 is that of a bit holder which may have a bit inserted in the top bore thereof. The embodiments shown in FIGS. 4 and 5, which include hardened tip or tip inserts, such as PCD diamond tipped or TSP diamond inserts, will be formed integrally with the body of each embodiment and do not rotate thereon as would a bit in the first embodiment shown in FIGS. 1-3. These diamond tipped and TSP diamond hardened tip inserts should provide substantial added life over that of tungsten carbide bits, such that rotation of the top thereof is not required to obtain substantial increase in service life. Of course, a rotatable diamond tipped bit might even provide longer in-service capability on a rotatable bit.

While three embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention

What is claimed:

1. A bit holder comprising:

an upper body portion and a hollow slotted generally cylindrical shank depending from said upper body portion, the shank comprising a first portion of a length of said shank, the first portion adjacent a distal end of said shank, and an outer surface of at least the first portion of the length of said shank having a constant frustoconical reverse taper extending away from an axis of said shank as it descends toward said distal end.

2. The bit holder as defined in claim 1 wherein said shank further includes:

a second portion adjacent said first portion, said second portion including a second portion diameter less than a first portion diameter of the first portion.

3. The bit holder as defined in claim 2 wherein:

said shank outer surface further includes a third portion adjacent a bottom of said upper body portion that is of increased diameter relative said second portion, said third portion including one of a cylindrical configuration and a tapered configuration.

4. The bit holder as defined in claim 3 wherein said first portion, second portion, and third portion of said shank comprise a combined length of less than 2½ inches.

5. The bit holder as defined in claim 3 wherein the slot of said hollow slotted generally cylindrical shank extends from said distal end thereof axially through said first portion thereof and through said second diminished diameter portion thereof terminating adjacent said third portion thereof.

6. The bit holder of claim 3, further comprising:

a shoulder disposed on said shank outer surface between the second portion and the third portion, wherein a diameter of the shoulder decreases as the shoulder axially extends from the third portion to the second portion.

7. The bit holder as defined in claim 1 further including:

a hardened tip integrally formed on a top of said upper body portion.

8. The bit holder as defined in claim 7 wherein said tip includes diamond material on top of a tungsten carbide substrate.

9. The bit holder as defined in claim 7 wherein said tip includes thermally stable polycrystalline diamond material.

10. A combination bit holder and base block comprising:

a bit holder having an upper body portion and a generally hollow cylindrical slotted shank depending therefrom, the shank sized to be non-rotatably mountable in use in a base block bore, a first portion of said shank adjacent a distal end thereof, the first portion including an outer surface of increasing diameter toward said distal end of said shank, and the base block comprising a receiving portion including the bore therein for receiving and holding said shank, said bore including a portion generally corresponding in hollow dimension to hold said first portion of said shank in compression at a similar position from a top of said bore as said first shank portion is from a bottom of said upper body portion.

11. The combination as defined in claim 10 said shank further includes a second portion adjacent the bottom of said upper body portion of generally cylindrical configuration, and said bore of said base block includes a top portion configured to form an annular interference fit with said second portion of said shank along at least a portion of their lengths.

12. The combination as defined in claim 10 wherein a top portion of said bore includes a waist defining a bottom thereof and a narrowest part of said bore.

13. The combination as defined in claim 12 wherein said bore corresponding in hollow dimension to said first portion of said shank extends from said waist toward a bottom of the receiving portion of said base block.

14. The combination as defined in claim 13 wherein an arcuate segment of said bore extends beyond the bottom of the receiving portion of said base block toward a bottom of a mounting portion thereof.

15. The combination as defined in claim 14 wherein said arcuate segment extends from said bottom of the receiving portion of said base block at an angle to an axis of said bore less than that of said bore below said waist thereof.

16. The combination as defined in claim 12 wherein:

a widest part of said shank when inserted in said base block bore past said waist of said bore is adapted to bias said shank to be fully inserted in said bore.

17. A combination bit holder and base block comprising:

said bit holder including a generally cylindrical hollow slotted shank, an outer surface of said shank including a frustoconical reverse taper segment adjacent a distal end thereof, said base block including a bore therein, said bore having a constant reverse taper portion generally complementary to said reverse taper segment of said shank when said shank is inserted in said bore, the shank sized to be securely mountable by elastic radial compression against the bore of the base block, and a widest part of said shank, when inserted in said base block bore past a top of said bore reverse taper portion, adapted to bias said shank to be fully inserted in said bore.

18. The combination as defined in claim 17 wherein:

said top of said reverse taper portion has a narrowest diameter of said base block bore.

19. The combination as defined in claim 17 wherein said shank includes:

a reduced diameter portion adjacent a top of said reverse taper segment, and said slot extending axially from said distal end of said shank, through said reverse taper segment, and substantially through said reduced diameter portion.

20. The combination as defined in claim 19 wherein said shank further includes:

a forward portion adjacent a top of said reduced diameter portion, said forward portion sized to form an interference fit with a top portion of said base block bore when said shank is fully inserted therein.

21. A combination bit holder and base block comprising:

said bit holder including a generally cylindrical hollow slotted shank, an outer surface of said shank including a frustoconical reverse taper segment adjacent a distal end thereof, said base block including a bore therein, said bore having a constant reverse taper portion generally complementary to said reverse taper segment of said shank when said shank is inserted in said bore, the shank sized to be securely mountable by elastic radial compression against the bore of the base block, and a widest part of said shank, when inserted in said base block bore past a top of said bore reverse taper portion, adapted to bias said shank to be fully inserted in said bore, and the widest part of said shank has a super interference fit with said bore reverse taper portion.

* * * * *